US006733430B1

(12) United States Patent
Chiari et al.

(10) Patent No.: US 6,733,430 B1
(45) Date of Patent: May 11, 2004

(54) UNIVERSAL EJECTION TOOL

(75) Inventors: Mauro Chiari, Denges (CH); José Rossier, Prilly (CH)

(73) Assignee: Bobst SA (CH)

( * ) Notice: Subject to any disclaimer, the term of this patent is extended or adjusted under 35 U.S.C. 154(b) by 87 days.

(21) Appl. No.: 09/632,025

(22) Filed: Aug. 2, 2000

(30) Foreign Application Priority Data

Aug. 2, 1999 (CH) ..... 1417/99

(51) Int. Cl.[7] ..... B31B 1/14
(52) U.S. Cl. ..... 493/342; 493/373; 493/343
(58) Field of Search ..... 493/342, 343, 493/344, 353, 373, 374; 225/1, 97, 93, 105

(56) References Cited

U.S. PATENT DOCUMENTS 3,786,731 A 1/1974 Bobst ..... 93/36
4,452,595 A * 6/1984 Huff ..... 493/373
5,529,565 A * 6/1996 Oetlinger ..... 493/342
5,735,442 A * 4/1998 Emrich ..... 225/1
5,810,233 A * 9/1998 Varidel ..... 225/97
6,095,962 A * 8/2000 Rebeaud ..... 493/373

FOREIGN PATENT DOCUMENTS

DE 8915577 10/1990

* cited by examiner

*Primary Examiner*—Mickey Yu
*Assistant Examiner*—Sameh Tawfik
(74) *Attorney, Agent, or Firm*—Ostrolenk, Faber, Gerb & Soffen, LLP

(57) ABSTRACT

This universal ejection tool (1) for the waste from a blanking press for cutting out sheet elements, particularly for a press for cutting sheet elements such as paper or cardboard intended for the production of packages, comprises a frame (2), the top part of which is equipped with a plate (10) perforated with a plurality of holes (11) uniformly distributed. The bottom part of said frame is provided with a plate (12) identical to the plate (10) and of substantially identical dimensions to those of the frame (2). Said plate (12) is also perforated with a plurality of holes (13), which are perfectly aligned with the holes (11) in pairs on vertical straight lines. Said plates (10, 12) are separated in the inner space of the frame (2) by a separating means. The vertical pairs of holes (11, 13) are traversable by ejection needles (30), which are simply held therein by a spring effect.

27 Claims, 3 Drawing Sheets

UNIVERSAL EJECTION TOOL

BACKGROUND OF THE INVENTION

1. Field of the Invention

This invention relates to a universal tool for ejecting the waste from a blanking press for cutting out sheet elements, particularly elements such as paper or cardboard intended for the production of packaging.

2. Related Art

Generally, these blanking presses comprise a plurality of stations disposed one after the other, more particularly a feeder for supplying the machine with sheets of cardboard, and in some constructions a feed table arranging said sheets in layers, a platen press for cutting the sheets one by one to a given shape to produce box blanks, an ejection station removing the unwanted waste resulting from the cutting operation, and finally a station for receiving the resulting blanks in stacks.

It is in the waste ejection station of the blanking press that the tool of this invention is used. The sheet elements processed by such machines each comprise a plurality of blanks which represent the shapes and developed surfaces of the packages made. Although these blanks are carefully disposed and arranged on the surface offered by the sheet in order to obtain optimum utilisation thereof, it is generally not possible to avoid interstitial zones of waste between the blanks resulting mainly from their specific shapes. It is these interstitial surfaces which form the unwanted waste which should be removed from the sheet.

To this end, once a sheet has been cut it is deposited on a perforate plate, a bottom ejection plate, comprising a plurality of openings. These openings are situated in register with the waste from the sheet and have a shape corresponding to such waste. Each waste item can be removed by clamping between two ejection needles mounted respectively on a top movable tool and the other telescopic needles on a bottom tool. In a vertical movement, these two tools in one operation remove all the waste from the sheet. An ejection station of this kind is described in greater detail in U.S. Pat. No. 3,786,731.

More simply, the waste ejection station can comprise just a single movable top tool pushing the waste through the perforate plate.

One method of making the ejection tool comprises using a flat surface, generally a wooden board, in which ejection needles are fixed at locations corresponding to the waste for ejection, said ejection needles simply being types of nail which have been nailed into the wooden board. Although appearing to be very economical, this solution becomes complex and soon becomes tedious when the machine has to be prepared for all kinds of different jobs each requiring a specific tool, in order to meet customer requirements.

Another embodiment of the ejection tool comprises using needles which can be adjustably fixed in order to allow more readily for a complete range of different jobs. To this end, the tool in question comprises a rectangular frame and cross-members connecting the side or longitudinal bars of the frame, so that said cross-members, serving as a support for the ejection needles, can be positioned at the locations of the waste for ejection. Each ejection needle must be screwed on a radially adjustable support which can turn through a 360° periphery in order to be able to be properly positioned with respect to the waste for ejection. This embodiment has the disadvantage of requiring, for each ejection needle, assembly and adjustment of a number of parts making up its support. Also, since the blanking press can carry out different jobs corresponding to a number of types and formats of blanks, the complicated adjustment of the position of the ejection tools depending on the required job has to be repeated each time. Although this tool has the advantage of being adaptable to any job and having just one and the same batch of parts, the positioning of the ejection needles is on the other hand an adjustment task which may be long and laborious depending on the complexity of the boxes to be cut and the waste they produce. Finally, the size, and particularly the relatively high cost price of this type of tool, necessitates rational utilisation of the system; for this reason, these ejection tools are generally dismantled after each job and re-assembled in a new configuration for a new job, and this obviously takes up an appreciable amount of time which is not compatible with the required production needs.

Another possible solution is not to separate the waste during production but to carry out the operation manually when removing the processed product delivered by the platen press. This solution, which is very restrictive for medium and large runs, is economically inconceivable in industrialised countries for obvious labour cost reasons. Also, the time required for this task would be totally disproportionate to the time taken by a machine to produce the required product in one operation. Finally, manual removal of the waste gives rise to different problems, such as the risk of tearing, risk of unwanted separation of processed blanks, problems associated with handling stacks of sheets, and finally hygiene problems for sheets intended for packing medical or food products.

The object of this invention is to obviate these disadvantages by providing a universal ejection tool which, above all, is economic and which is of simple design while remaining effective and reliable. It must also be capable of ejecting any type of waste no matter where over the entire extent of the sheet and be suitable for jobs covering the entire range of sheet formats which it is possible to produce with the type of platen press for which the ejection tool in question is provided. The time required for preparation of this tool for a given job must be as short as possible. This ejection tool must also significantly reduce the number of operations and spare parts involved in the tool preparation stage, and must offer manifest convenience in the case of adding, removing or moving one or more of the means providing the waste ejection.

To this end, the invention relates to an ejection tool according to claim 1.

The invention will be more readily understood from one embodiment which has no limiting force and which is illustrated in the accompanying drawings wherein:

DETAILED DESCRIPTION OF THE INVENTION

Figure 1:
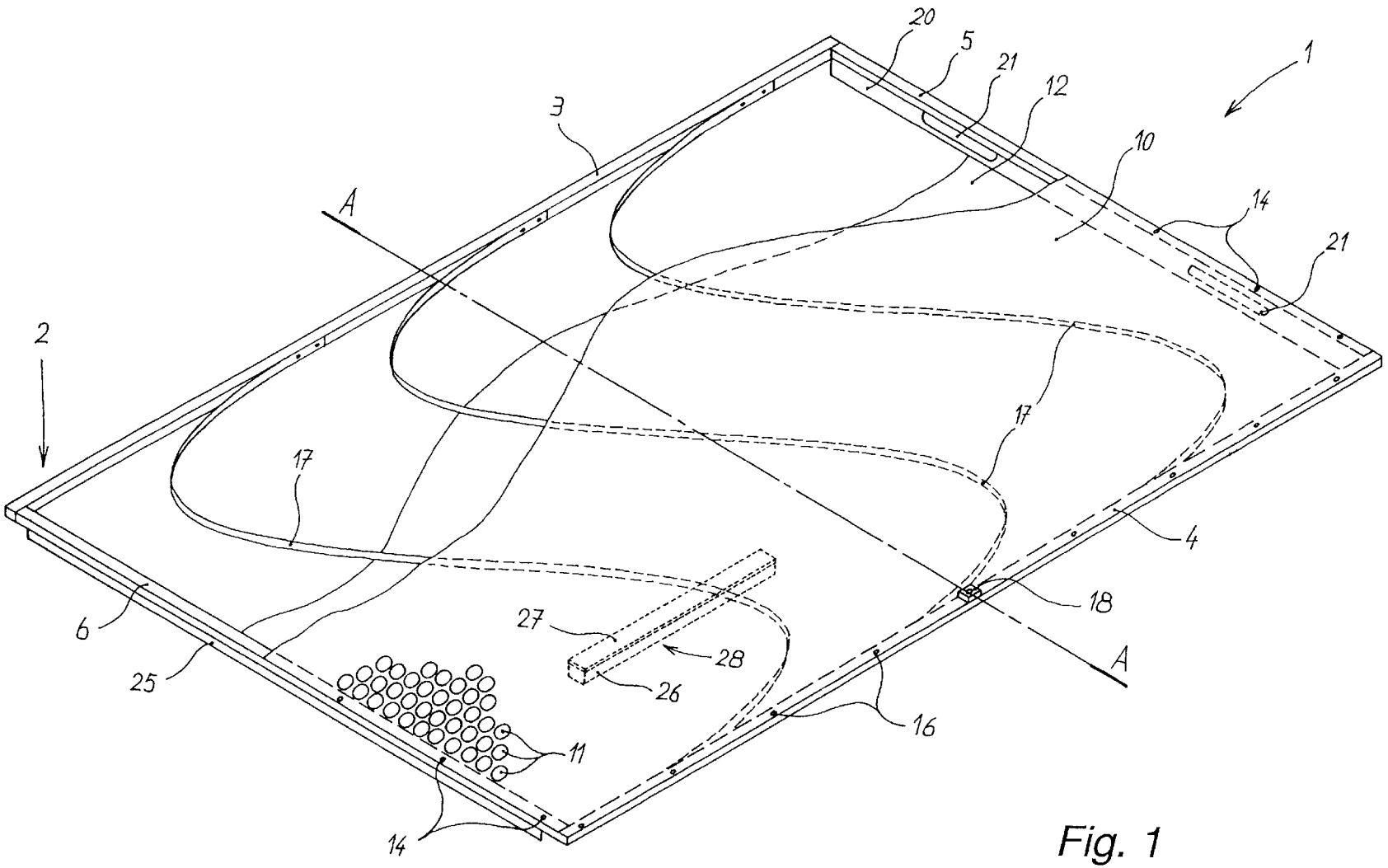
FIG. 1 is a diagrammatic perspective and partial section of a universal ejection tool according to the invention.
Figure 2:
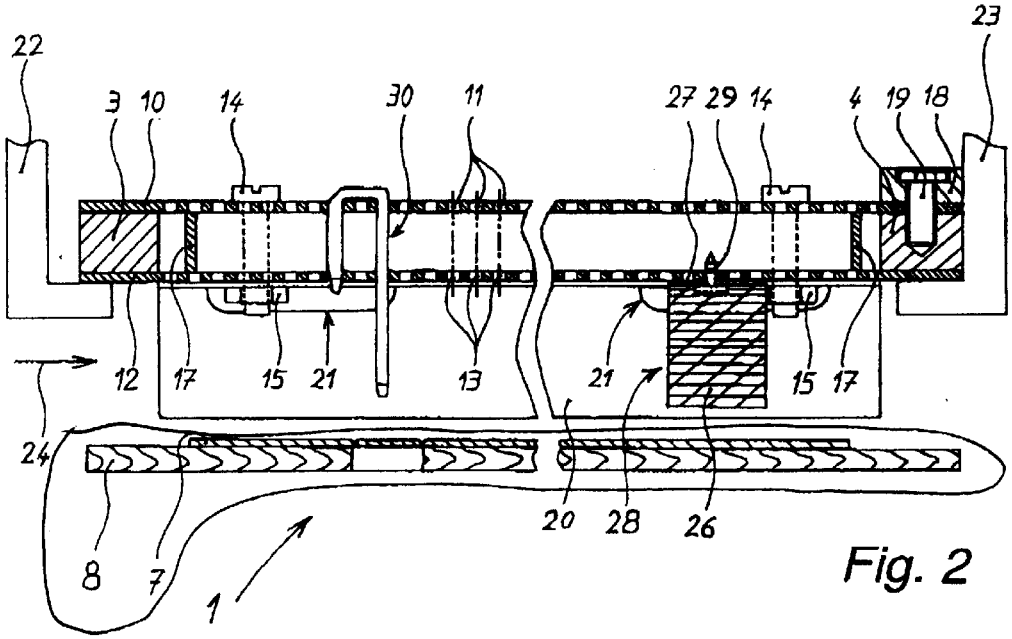
FIG. 2 is a diagrammatic vertical partial section of the ejection tool on the central line A—A in FIG. 1.

FIG. 1 is a diagrammatic perspective view in partial section of a universal ejection tool 1. The latter comprises a frame 2 formed by two longitudinal bars 3, 4 firmly connected to two other side bars 5, 6. The bars are preferably of rectangular or square section. The top surface of the frame 2 serves as a support for a top plate 10 perforated with a plurality of small holes 11. A bottom plate 12 also perforated with a plurality of small holes 13 (FIG. 2) of the same diameter as the holes 11 is fixed against the bottom surface of the frame 2. The plates 10 and 12 are identical and their dimensions are substantially equal to those of the frame 2. They are fixed on the latter by through screws 14 which can be countersunk in the plate 10, and nuts 15 on the side bars 5, 6 of the frame 2, and with screws 16 clamped in blind screwthreads for the longitudinal bars 3, 4. All the holes 11 and 13 are absolutely opposite one another and are therefore perfectly aligned in pairs on vertical straight lines (FIG. 2). In the diagrammatic FIG. 1, the holes are voluntarily drawn in exaggerated proportion. In actual fact, each plate can, for example, be perforated with a number of between 50,000 and 400,000 holes for a plate area of between 1 and 2 $m^2$. Preferably, the said holes form for each plate 10, 12 a field such that the centres of any three adjacent holes form the apices of an equilateral triangle, one of the sides of the triangle being parallel to one of the edges of the frame 2.

In order to avoid any deformation of the plates, separating means formed by a plurality of strips 17 are positioned on edge between the two plates 10, 12. These strips 17 each form an S which connects the two longitudinal bars 3, 4 of the frame 2. They are fixed only in their ends against the inner edges of said bars.

The positioning and register of the ejection tool 1 in the ejection station is effected by means of one of the longitudinal bars and a centring stud 18 positioned on an axis A—A indicated in FIG. 1. This virtual axis is situated on the central line of the production machine and forms a reference line. All the stations (introduction, cutting, ejection, etc) of this machine are aligned with respect to said axis so that the different operations carried out on one and the same sheet element are always carried out in perfect register.

FIG. 2 is a partial vertical section of the ejection tool 1 on the central line A—A. The centring stud 18 is carefully fixed on the top plate 10 by means of a screw 19 anchored in the longitudinal bar 4. A bent plate 20 is fixed by screws 14 along the lateral bar 5 beneath the bottom plate 12. The said bent plate 20 is provided with gripper means 21 formed by two openings which enable the tool 1 to be engaged and pulled like a drawer out of the ejection station. FIG. 2 shows two longitudinal supports 22, 23 which, although forming part of the ejection station, enable the way in which the ejection tool 1 is introduced and held therein to be more readily understood. The support 23 is fixed; it serves as a reference against which the longitudinal bar 4 abuts. The support 22 is in turn movable in the direction of the arrow 24 so as to clamp and hold the tool 1 firmly in the ejection station. Remote from the bent plate 20 is another plate 25, the dimensions and fixing means of which are identical to those of the first bent plate 20.

FIG. 2 shows only one ejection needle 30 as introduced into the tool 1. For reasons associated with the relationship between the size of the holes 11 and the thickness of the tool 1, no ejection needle is shown in FIG. 1. The height of each of the ejection needles 30 is smaller than the height of the bent plates 20, 25 mounted on the frame 2. In fact, one of the objects of the bent plates 20, 25 is also to be able to deposit the tool 1 on a flat surface without the ejection needles 30 lifting once they are positioned in the holes 11, 13.

During the waste ejection phase by means of the needles 30, the process requires that the sheet 7 should be held absolutely flat against the perforated plate 8. To this end, support means are fixed against the bottom surface of the ejection tool next to the idle surfaces. In FIG. 2, a support means 28 of this kind is shown in section. Said support means 28 comprises a stud 26 of compressible foam stuck against a magnetised surface 27, which, as a result of the plate 12 advantageously being machined from a ferromagnetic material, can be arbitrarily positioned over the entire extent of said plate. Another advantage of this fixing system lies in the fact that said support means 28 can readily be adjusted if necessary, and recovered for future use for preparation of another job.

A variant of the method of fixing said support means 28 against the plate 12 comprises equipping said means with at least two nails 29 which, extending through the holes 13 in the plate 12, prevent any slip or any other unintentional movement of the support means 28. In this way, the reliability of the ejection tool is further improved without adversely affecting the time required for its preparation. To ensure perfect assembly between a support means 28 of this kind, equipped with nails 29, and the perforate plate 12, it is necessary that the distance between the nails 29 should be equal to a multiple of the pitch of the holes 13 uniformly distributed in the plate 12.

Figure 3:
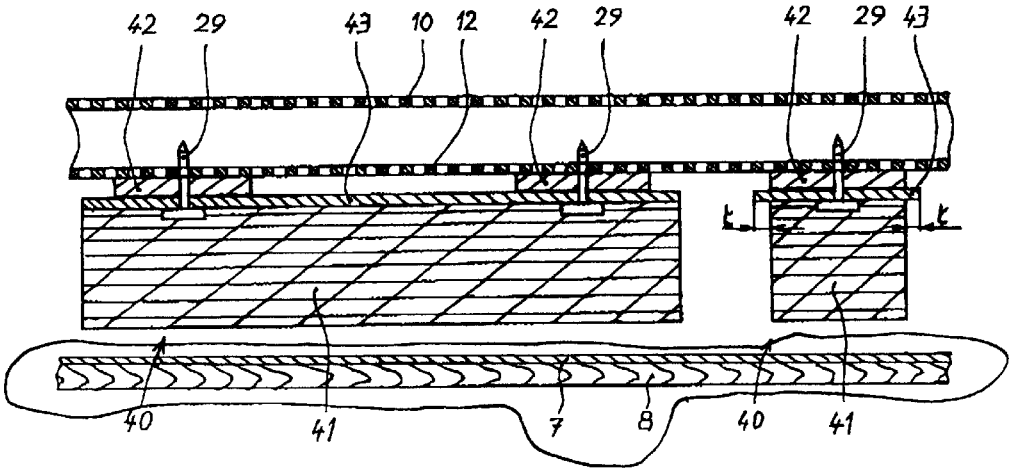
FIG. 3 is a diagrammatic vertical section of part of the universal ejection tool.

FIG. 3 is a diagrammatic vertical section of part of the universal ejection tool. When waste of a sufficiently large area has to be ejected, it is more advantageous to use ejector means 40 instead of the ejection needles 30. In fact, because of their small size, the latter are more particularly useful in the case of removal of small waste, while larger ejector means 40 are more appropriate in the case of the ejection of large waste; for example, the contour of a sheet from which it is required to separate the rest of the blanks cut therefrom.

To this end, the ejector means 40 can be simply formed by the same elements as those which already form the support means 28, except for the difference that instead of using a stud 26 of compressible foam it is preferable to use a relatively incompressible rigid foam stud 41.

FIG. 3 shows in section, respectively in front view and profile, two ejector means 40 mounted as required on the bottom surface of the perforate plate 12. The construction of these ejector means 40 as illustrated in this Figure constitutes a second possible variant which differs slightly from that preferably used for the support means 28. In order to increase the force of cohesion of the ejector means 41 against the plate 12, two powerful magnets 42 are rigidly fixed against a steel plate 43 which is in turn attached against the stud 41. In a preferred embodiment, nails 29 extend through the ejector means 40. The object of these nails is the same as that described above for the support means 28.

The stud 41 of the ejector means 40 is slightly offset from two of the edges of the steel plate 43 which forms the base of the ejector means 40. This offset t facilitates the exact positioning of the edge of the stud 41 with respect to the perforate plate of the ejection station. This characteristic facilitates the placing of the ejector means 40 when they have to be positioned as close as possible to the edges of the surfaces for ejection. In fact, the size of the openings in the perforate plate, used for positioning the ejector means and the ejection needles, differs slightly from the size of the waste for ejection so that the said offset t enables this slight difference to be compensated without any problem.

Figure 4:
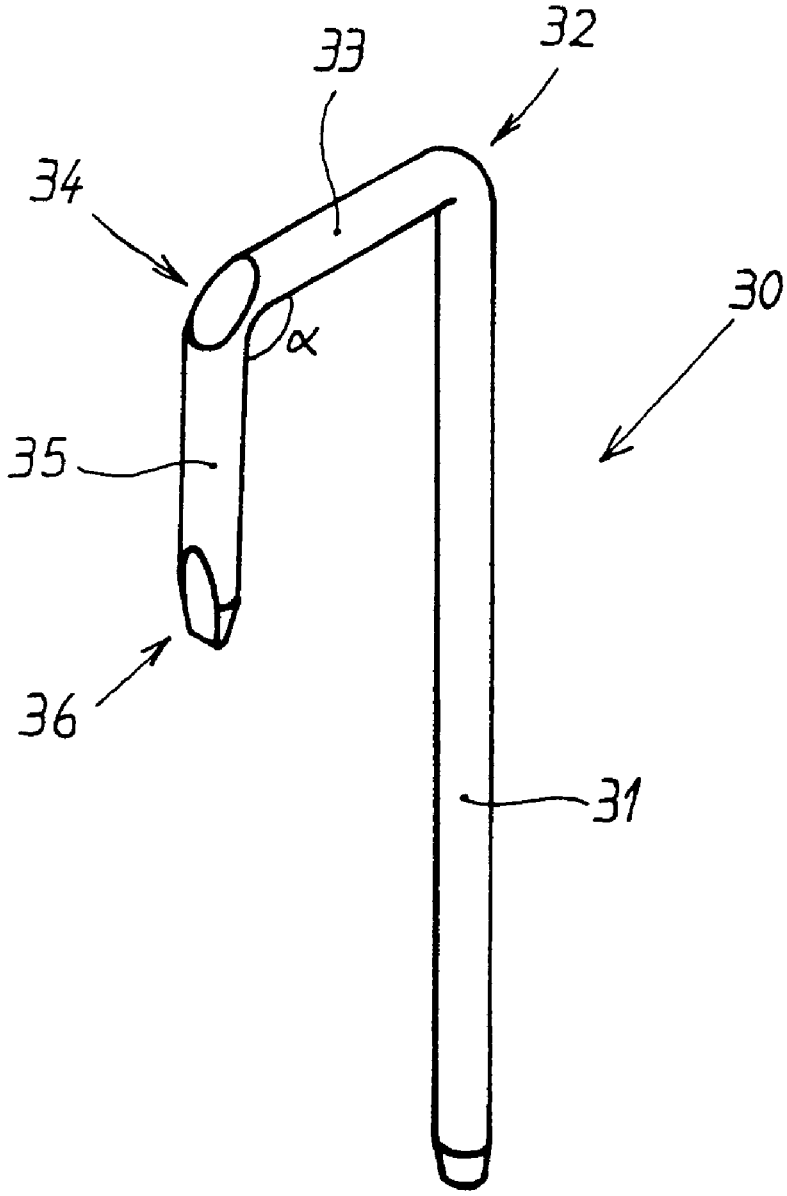
FIG. 4 is a perspective view of an ejection needle according to the invention.

FIG. 4 is a perspective view of an ejection needle 30. Simple to make, this needle is not telescopic but resembles a hook formed by a rod bent firstly at right angles and then a second time in the same direction at an angle $\alpha$ of preferably between 87° and 90°. Bending of this rod respectively defines a first long arm 31, a bend 32, a section 33, a second bend 34, and finally a second arm 35 shorter than the first. The length of the second arm 35 is very slightly greater than the distance between the top and bottom plates 10, 12 while the length of the first arm 31 actually forms the needle which will push down the waste for separating from the sheet element. The diameter of the ejection needle rod is slightly less than the diameter of the holes 11, 13 so that said needles can easily be introduced therein manually. Once placed through the ejection tool 1, the ejection needle 30 is held therein by the relative elasticity of the non-parallel arms 31, 35, which naturally tend to move apart. To facilitate introduction of these needles through the holes 11, 13, one end 36 of the arm 35 is chamfered, on the one hand, and the second bend 34 is beveled with an oblique flat, on the other hand.

Advantageously, as a result of the flexibility of the means separating the top and bottom plates 10, 12, the strips 17 do not constitute an obstacle to the ejection needles 30, which must be placed at exact locations. In fact, if one of the strips 17 exactly passes in register with a hole through which one of the ejection needles must extend, said needle can without problem remove the strip 17 from its path so as to be correctly introduced into the ejection tool.

Another possible solution for avoiding any deformation of the perforate plates 10, 12 would be to replace the strips 17 by rectilinear strips or sheets of rigid PVC foam for example. The introduction of the ejection needles 30 in that case could readily pierce the said rigid foam.

In the present description, the preferred embodiment of the ejection needles in no way excludes a different method of making them. For example, the production of a needle of this kind could comprise using just a straight rod, along which there would be attached a spring strip, and a stop means at the top end of said rod. Said means would prevent the rod from being introduced too deeply into the ejection tool, while the spring strip would enable the rod to be locked in the vertical pair of holes 11, 13 by its elastic effect.

Numerous improvements can be made to this ejection tool within the scope of the claims.

What is claimed is:

1. A universal tool for ejecting waste from a blanking press for cutting sheet elements intended for production of packages, comprising:

a frame having:

a top part including a first plate perforated with a plurality of first holes uniformly distributed over its entire surface; and a bottom part including a second plate, the second plate also being perforated with a plurality of second holes which are perfectly aligned with respective ones of said first holes in pairs on vertical straight lines, the first and second plates being separated in the inner space of the frame by a separating device, the vertical pairs of holes being traversed by ejection needles which are releasably held therein by a spring effect, and which extend beyond the second plate to engage the sheet elements.

2. A universal ejection tool according to claim 1, in which the separating device is comprised of a plurality of strips positioned on edge and held by ends thereof against edges of the free.

3. A universal ejection tool according to claim 1, in which one of the first and second plates is provided with a centering stud fixed on a longitudinal reference axis on the blanking press.

4. A universal ejection tool according to claim 1, in which the frame includes, on its bottom part, feet which are longer than the ejection needles.

5. A universal ejection tool according to claim 1, in which each ejection needle comprises:

two arms formed from a single bent rod, the rod being bent once at a right angle and a second time in the same direction at an angle less that 90° so that the ejection needle can be introduced in one operation into two vertical pairs of holes and is retained therein by relative elasticity of the two arms;

ends and angular parts of the ejection needle being beveled.

6. A universal ejection tool according to claim 1, in which the holes in the first and second plates are arrayed such that the centers of any three adjacent holes in the respective plates form the apices of an equilateral triangle, one of the sides of which is parallel to one of the edges of the frame.

7. A universal ejection tool according to claim 1, in which:

the frame has a format corresponding to a maximum production formal possible with the platen press; and the pairs of holes in the first and second plates are so arranged that each waste item resulting from any cut sheet element can be removed by at least one ejection needle.

8. A universal ejection tool according to claim 1, in which each ejection needle is comprised of a resilient member which exerts a spring force on the walls of the holes through which it is inserted.

9. A universal ejection tool according to claim 1, in which each ejection needle is comprised of:

two arms formed from a single bent rod, the rod being bent once at a right angle and a second time in the same direction at an angle less that 90° so that said ejection needle can be introduced in one operation into a pair of holes in the plate, the ejection needle being retained in the holes by relative elasticity of the two arms.

10. A universal ejection tool according to claim 9, in which the ends of the arms are beveled.

11. A universal ejection tool according to claim 1, in which each ejection needle comprises:

a first arm which engages the waste material during operation; and a second arm which is shorter than the first arm, the two arms being formed from a single resilient rod, the rod being bent once at a right angle to form the first arm and bent a second time in the same direction at an angle less that 90° to form the second arm, the spacing between the arms being such that the ejection needle can be introduced in one operation into a pair of holes in the plate, and is retained therein by relative elasticity of the two arms.

12. A universal ejection tool according to claim 11, in which ends and angular parts of the ejection needle are beveled.

13. A universal ejection tool according to claim 1, in which the second plate is identical to the first plate.

14. A universal tool for ejecting waste from a blanking press for cutting sheet elements intended for production of packages, comprising:

a frame;

a first plate mounted in the frame, the first plate being formed of ferromagnetic material;

a support structure which supports the first plate against vertical deformation, the support structure being comprised of a compressible foam stud coated pith a magnetized surface that adheres magnetically against the first plate; and a waste ejector, the waste ejector being comprised of:

a second stud formed of a substantially incompressible material;

a second steel plate adhered to the second stud; and a magnet which secures the first and second plates together.

15. A universal ejection tool according to claim 14, in which the second stud is slightly offset with respect to at least two edges of the second plate.

16. A universal ejection tool according to claim 14, in which the support structure and/or the ejector includes at least two nails which extend through aligned holes in the first and the second plate to prevent any possible slip between the two plates.

17. A universal tool for ejecting waste from a blanking press for cutting sheet elements intended for production of packages, comprising:

a frame;

a plate mounted in the frame, the plate being perforated with a plurality of holes uniformly distributed over its entire surface so that there are holes across the entire surface;

a support member which supports the perforated plate against vertical deformation; and a plurality of waste ejection needles which are inserted in at least some of the holes in a pattern corresponding to the waste portions to be ejected, the needles being removably retained in the holes by a spring effect therebetween.

18. A universal ejection tool according to claim 17, in which the separating device is comprised of a plurality of strips positioned on edge and held by ends thereof against edges of the frame.

19. A universal ejection tool according to claim 17, in which the frame includes feet which are longer than the ejection needles.

20. A universal ejection tool according to claim 19, in which said feet are formed by bent plates, at least one of which is provided with a gripping device.

21. A universal ejection tool according to claim 17, in which the ejection needles are comprised of a resilient member which exerts a spring force on the walls of the holes through which they are inserted.

22. A universal ejection tool according to claim 17, in which each ejection needle comprises:

two arms formed from a single bent rod, the rod being bent once at a right angle and a second time in the same direction at an angle less that 90° so that said ejection needle can be introduced in one operation into a pair of holes in the plate, the ejection needle being retained in the holes by relative elasticity of the two aims.

23. A universal ejection tool according to claim 22, in which the ends of the arms are beveled.

24. A universal ejection tool according to claim 17, in which each ejection needle comprises:

a first arm which engages the waste material during operation; and a second arm which is shorter than the first arm, the two arms being formed from a single resilient rod, the rod being bent once at a right angle to form the first arm and bent a second time in the same direction at an angle less that 90° to form the second arm, the spacing between the arms being such that the ejection needle can be introduced in one operation into a pair of holes in the plate, and is retained therein by relative elasticity of the two arms.

25. A universal ejection tool according to claim 24, in which ends and angular parts of the ejection needle are beveled.

26. A universal ejection tool according to claim 17, in which the holes in the plate are arrayed such that the centers of any three adjacent holes form the apices of an equilateral triangle one of the sides of which is parallel to one of the edges of the frame.

27. A universal ejection tool according to claim 17, in which:

the frame has a format corresponding to a maximum production format possible with the platen press; and the holes are so arranged that each waste item resulting from any cut sheet element can be removed by at least one ejection needle.

* * * * *